United States Patent [19]

Shah

[11] 4,376,485

[45] Mar. 15, 1983

[54] METHOD FOR RAPIDLY TESTING QUALITY OF INCOMPLETELY CHARGED ELECTROCHEMICAL CELLS

[75] Inventor: Rameschandra V. Shah, Gainesville, Fla.

[73] Assignee: General Electric Company, Gainesville, Fla.

[21] Appl. No.: 205,908

[22] Filed: Nov. 12, 1980

Related U.S. Application Data

[63] Continuation of Ser. No. 63,433, Aug. 3, 1979, abandoned, which is a continuation of Ser. No. 812,727, Jul. 5, 1977, abandoned.

[51] Int. Cl.[3] ..... B07C 5/344

[52] U.S. Cl. ..... 209/575; 324/432; 324/435

[58] Field of Search ..... 209/573, 575; 320/21, 320/48; 324/426–430, 432–437

[56] References Cited

U.S. PATENT DOCUMENTS

| | | | |
|---|---|---|---|
| 1,832,948 | 11/1931 | Schmidt | 209/575 |
| 2,644,132 | 6/1953 | Christie et al. | 324/434 |
| 2,921,254 | 1/1960 | LaMarche | 320/48 |
| 3,082,871 | 3/1963 | Duncan | 209/572 X |
| 3,392,328 | 7/1968 | Figg | 324/435 |
| 3,487,284 | 12/1969 | Cady | 320/21 X |
| 3,500,167 | 3/1970 | Applegate et al. | 324/426 X |
| 3,614,583 | 10/1971 | Burkett et al. | 320/21 X |
| 3,857,087 | 12/1974 | Jones | 320/48 |

OTHER PUBLICATIONS

*Nickel-Cadmium Battery,* Application Engineering Handbook, General Electric Co., Publication No. GE-T-3148A (1975), pp. 7-12 thru 7-16.

*Primary Examiner*—Robert B. Reeves
*Assistant Examiner*—Edward M. Wacyra
*Attorney, Agent, or Firm*—Henry J. Policinski

[57] ABSTRACT

A method for rapidly testing rechargeable electrochemical cells following assembly which enables the testing of cells to be carried out in a substantially uncharged condition. Cells in the assembly line are energized with a constant current pulse applied to their electrodes via the cell terminals, the current being of sufficient magnitude and duration so as to develop an increased charge voltage between the cell terminals. The charge voltage so developed during the application of the current and while the electrodes of the cell are incompletely charged is then measured and compared with a predetermined zone of acceptable values for cell performance. Preferably, the developed charge voltage is permitted to stabilize prior to measurement. In addition, measurements of open circuit voltage are taken immediately before and after application of the current pulse.

28 Claims, 5 Drawing Figures

METHOD FOR RAPIDLY TESTING QUALITY OF INCOMPLETELY CHARGED ELECTROCHEMICAL CELLS

This is a continuation of application Ser. No. 63,433 filed Aug. 3, 1979, now abandoned, which, in turn, is a continuation of application Ser. No. 812,727 filed July 5, 1977, now abandoned.

BACKGROUND OF THE INVENTION

This invention relates to the testing of electrochemical cells during the manufacturing process and, in particular, to the testing of rechargeable type electrochemical cells.

It is accepted practice in the electrochemical cell manufacturing industry to subject each manufactured cell to a test procedure for the purpose of checking cell performance. In the case of electrochemical cells of the rechargeable type, performance is ascertained by measuring the electrical characteristics of the cell after it has been fully charged. The exact nature of these tests varies from one manufacturer to another but, in general, each involves impressing a full electrical charge (or even overcharge) on the cell and, only then, measuring the cell voltage. Thereafter the cell may be discharged to a predetermined level in order to provide a measure of the length of time for discharge or the magnitude of the discharge current.

In one currently followed procedure, rechargeable nickel-cadmium cells are taken from the assembly line and placed in apparatus which charges the cells at a rate that is a fraction of the one-hour power current rating ("C") for the cell. This charging is carried out for a time sufficient to effect at least a certain degree of overcharge to the cell. For example, a typical sealed nickel-cadmium cell is charged at the 0.1C rate for 24 hours (C being the current rating of the cell at one hour). This results in the cell's being supplied with a charge equal to 240% of its rated capacity, and the average normal cell may be in overcharge for perhaps 5–7 hours in order to ensure that all cells subjected to the ensuing tests are completely charged.

Prior to terminating the 0.1C charging current applied into the cell, the cell voltage is measured. This voltage measurement generally provides an indication of an insufficient electrolyte plate mismatch, presence of carbonates or a shorted condition of the cell. A cell voltage while the cell is being charged which is abnormally high indicates a low electrolyte plate mismatch or presence of carbonated condition, whereas a charge voltage which is abnormally low tends to indicate a short.

After this voltage measurement, the cell is subsequently discharged at the rate of 2C (i.e., at a discharge current which is double the one hour current rating C of the cell), and the time needed for the cell to reach a subnorminal voltage is recorded. The discharge time provides an indication of several of the characteristics of the cell, including its capacity, normal or abnormally low electrolyte, leaks, and shorted conditions. If any of the latter conditions exist, the discharge time will be less than the acceptable rating for the cell. This discharge test is founded on the volt-discharge characteristic for the cell. In the case of nickel-cadmium cells, the nominal cell voltage is 1.25 volts. The voltage of a cell which has been fully charged may typically range up to 1.27–1.35 volts. This voltage is relatively constant, dropping to about 1.2 volts when the cell has been discharged by the rated amount and, if discharge continues thereafter, the cell voltage drops abruptly after the voltage reaches about 1.0 volts.

Tests now performed on electrochemical cells, by charging and subsequently discharging the cell, generally provide complete information of the cell behavior and are more than adequate to detect most manufacturing faults or other cell defects; but the procedure has many drawbacks. Space and machinery must be provided in the plant for charging, discharging, and conducting measurements on the cells. Since the cells must be charged for up to 24 hours before any kind of measurement is performed, a great deal of storage space must be provided to accept the full 24-hour plant output of cells so that the cells can be loaded into the charger. It is difficult to conduct such charging on cells on a moving production line due to the large number of cells which are produced over the period of 24 hours (this would require an extremely long track to store and to charge moving cells) and, accordingly, charging is usually done on a batch basis whereby a great number of cells are inserted into the charger at the same time for charging. The second drawback has to do with the discharging of the cell. Adequate electronic circuitry must be provided in order to sense when the cell voltage of each individual cell has attained the predetermined voltage level (e.g. one volt) and then open the discharge path in order that the cell not be put into an overdischarged condition. Discharge of the cell, being at the 2C rate, consumes another thirty minutes of testing time, following which the last series of electrical measurements are made.

From the foregoing, it can be appreciated that a great deal of storage space, testing machinery and time are consumed in the mere testing of the cells owing to the fact that each manufactured cell must be charged and discharged. The testing procedure becomes, in essence, a bottleneck.

SUMMARY OF THE INVENTION

The present invention largely eliminates the production bottleneck of cell testing and provides a reliable check of the most common defects encountered in the mass production of recharging electrochemical cells. All test measurements of the method can be accomplished in one or two seconds at a station on the actual cell assembly line; for example, at a station immediately after the cell has been sealed.

Briefly, the method of the present invention is to apply a relatively large current pulse of short duration to the terminals of the cell as it is moved along the assembly line, this current preferably being relatively constant over the short duration of application and being applied for such time as to develop an increased charge voltage between the cell terminals. Before terminating the applied current pulse, the voltage across the cell terminals is measured and compared against a predetermined level, or levels, representative of satisfactory cell performance. In most cases, this single measurement and comparison will provide an indication of low resistance shorts, insufficient electrolyte material and normal cell voltage.

Preferably, the procedure will include one or more other measurements, made at the same station along the production line, such additional measurements including (1) a measurement of the open circuit voltage across the cell terminals prior to application of the current pulse and (2) a measurement of the open circuit voltage of the cell immediately after termination of the current pulse. The first measurement provides an unambiguous indication of a "hard" short between the electrodes or terminals of the cell, whereas the second measurement provides an unambiguous reading of a high resistance shorted condition as well as of insufficient electrolyte material.

A significant aspect of the method is that the cell is tested while in a substantially uncharged condition. Thus, if the cell has been assembled with "unformed" electrodes, it is not necessary to form (i.e., activate the electrodes through complete charging) prior to testing, although the test is applicable to cells where electrodes have been termed during manufacture. The total current charge applied to the cell during test may typically be less than 1/1000th of the cell's fully charged capacity, and the applied charge will rarely need to exceed 1% in order to achieve the response necessary to carry out the voltage measurements.

Reference to the following more complete description of the invention and to the accompanying drawings will provide a better understanding of the nature of the test measurements and the manner in which they can be practiced on the assembly line.

DETAILED DESCRIPTION OF PREFERRED EMBODIMENT

As mentioned above, it was the practice heretofore to test the performance of newly manufactured electrochemical cells by first charging them fully to their maximum storage capacity prior to undertaking any performance measurements. It has now been discovered, however, that it is possible to obtain valuable performance indicia by monitoring the voltage characteristics of substantially uncharged cells, i.e., cells to which only a low fractional charge has been supplied. As will be discussed shortly this low charge can be applied, and measurements taken in the span of one second or less, as compared with the previously used procedure consuming 20 to 25 hours.

Figure 1:
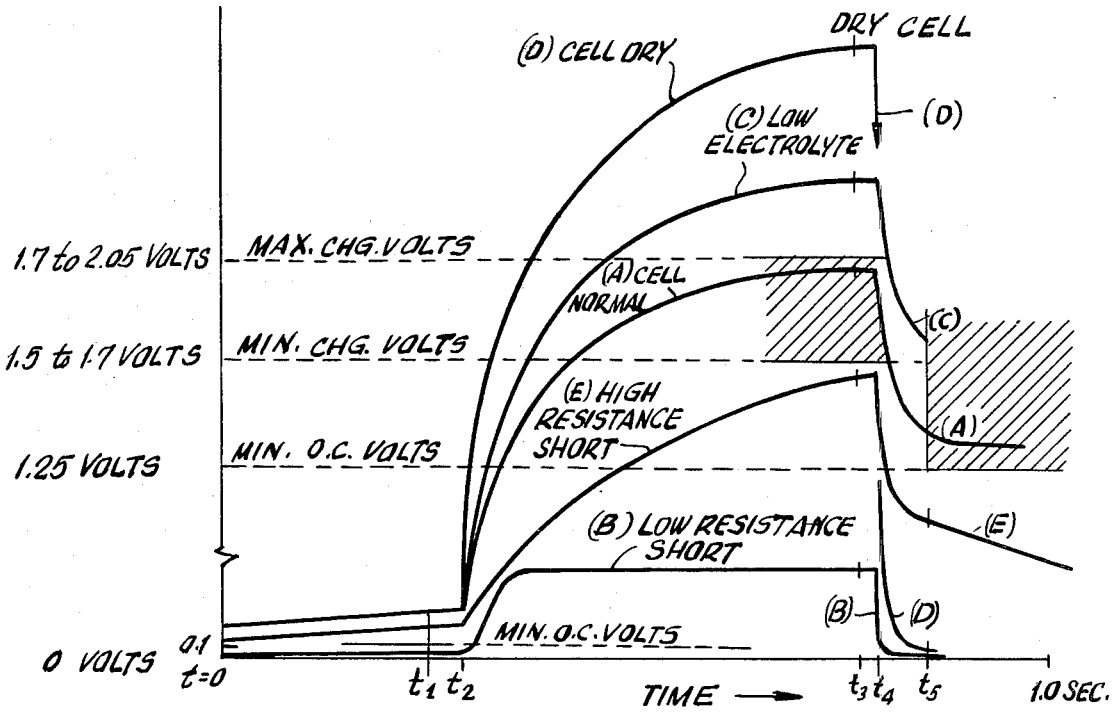
FIG. 1 is a graph containing several curves plotting exemplary cell voltages as a function of time under various assumed conditions.

FIG. 1 plots the voltage characteristic of such incompletely charged electrochemical cells as a function of time ranging from a reference time ($t=0$) to one second ($t=1$). However, the test (and scale) might be extended upto two seconds or more. The time $t=0$ represents a point in time in the manufacture of a cell shortly following assembly of its component parts.

Curve A on FIG. 1 illustrates the terminal voltage behavior of a normal cell when tested according to the invention. When a cell has been assembled, as for example by crimping the top edges of the battery casing (forming the negative battery terminal) over the edges of the insulated positive terminal forming the top closure member for the cell, the uncharged cell is shorted by the crimping or vertical sizing die. When the cell exits from this station in its assembly, if it is a nickel-cadmium cell, the incipient chemical charge tends to induce a steady but very slow increase in the open circuit voltage. This slow buildup can be seen to be occurring between the times $t=0$ and $t_2$. The buildup rate is such that a normal cell will reach its full nominal open circuit voltage is about 2–48 hours. After only a few minutes or less (e.g., at $t_1$), however, this open circuit voltage will usually not exceed a few tenths of a volt.

Although exceedingly minute, this pre-charge open circuit cell voltage provides meaningful information on cell performance. Specifically, cells which are shorted by a very low resistance can be detected by voltage measurement, for these cells do not exhibit the degree of voltage buildup comparable to that exhibited by healthy cells. For nickel-cadmium cells, it was found that comparing the open circuit voltage of the unchanged assembled cell against an empirically determined minimum level of, for example, 0.01 volt, will detect most cases of low resistance shorting, and all cases of direct shorts between the terminals.

The next region depicted in FIG. 1 illustrates the behavior of the cell terminal voltage during the time that a current pulse of constant amplitude is applied. Such current is applied over the interval $t_2$ to $t_4$, during which the terminal voltage is seen to ascend rapidly at first and then to level off. The duration of this current pulse and its magnitude are chosen such that the voltage at the terminals of a normal cell will reach a predictable and stabilized, or substantially constant, value prior to termination of the current pulse. Accordingly, the cell voltage is sampled prior to terminating the applied current pulse and compared for correspondence with predetermined maximum and minimum levels.

In a normal cell with satisfactory performance, the voltage at stabilization will fall within a predicted zone, depending upon electrode structure, normal internal cell resistance, and similar factors. For nickel-cadmium cells, whose nominal rated output voltage is 1.25 volts, the region of acceptable voltage at the cell terminals during the application of the charging current will range generally between 1.35 and 2.05 volts. Ordinarily, the voltage spread between the minimum and maximum acceptable value for any single type of sealed nickel-cadmium cell will not exceed about 0.35 volts. Moreover, a healthy cell will develop a voltage which at least equals, and generally exceeds, the nominal open circuit voltage of a fully charged cell (1.25 volts).

The minimum and maximum acceptable values are chosen such that cells exhibiting low electrolyte (or no electrolyte) and cells exhibiting various degrees of interelectrode shorting, will fall outside the minimum and maximum values. If desired, these acceptance values can be initially determined empirically by comparing measured voltages against cells with known defects. Cells filled with insufficient electrolyte exhibit a terminal voltage in excess of the maximum acceptable limit (curve C, low electrolyte and curve A, no electrolyte). Cells having both low and high resistance shorting, on the other hand, will develop sublevel terminal voltages (curve B, low resistance short and curve E, high resistance short).

As noted, the amplitude of the current pulse is selected to obtain the desired voltage stabilization, bearing in mind the desirability of completely testing cells at a rate equalling the cell product rate, vis., one cell every few seconds. To bring the cell rapidly up to the testing level, it is preferable to apply current at a level greater than the C rating of the cell. Thus, a cell rated at 500 mAh (milliampere hours) would receive a current no less, and preferably several times greater than 500 ma. Sealed cells of the AA, 1/2AA, sub-C, and C sizes and discharge-rated between 65 mAh and 1.2 Ah have been successfully tested at 2.5A, or at currents between 2C and 40C.

The three comparison measurements just described could well be sufficient to detect all normally encountered manufacturing faults. Since, however, the terminal voltage of a shorted cell will depend upon the value of the internal shorting resistance, it is possible for some cells having high resistance shorts (e.g., curve E) to develop terminal voltages at about the minimum threshold value for acceptable cells. In other words, an occasional cell, although shorted by high resistance, might develop an acceptable terminal voltage with current applied. For this reason, it is preferred to undertake a fourth measurement substantially immediately following termination of the applied current pulse as a cross-check and to eliminate any ambiguity. This measurement occurs at time $t_5$ in FIG. 1 by sampling the open circuit cell voltage.

Once the current pulse is removed, the terminal output voltage of the cell descends rapidly. For a normal cell, the terminal voltage will decline to a level above the nominal 1.25 volt value (a fully charged cell would exhibit an open circuit output voltage of approximately 1.3–1.4 volts). Cells which are shorted, however, rapidly lose terminal voltage due to the internal shorting. Cells which have no electrolyte likewise exhibit a rapid fall is open circuit output voltage, but to a level below the nominal rated cell voltage. Thus, only those cells exhibiting the behavior indicated by curves A,C in FIG. 1, will exhibit an open circuit voltage meeting the accepted minimum value when current is removed.

A further observation can be made from FIG. 1; that is that each of these curves has a different slope (dv/dt) at a particular time during the presence of the current pulse. Though it was found advantageous to sample a cell voltage after it has stabilized, it is envisioned that certain other measurements of the cell's volt-time characteristics can be made during application of the current pulse. As one example, the terminal voltage signal can be differentiated to obtain an electrical signal proportional to dv/dt as an indication of the acceptability or non-acceptability of cell performance. No matter which particular indicia of charge voltage is used, the method permits cell performance to be tested rapidly while the cell is still on the assembly line, thus avoiding the expensive, lengthly and labor intensive methods previously employed.

As a supplemental quality-control measure, it is open to the manufacturer to sample-test a small portion of bell productiontion by the conventional discharge method to verify adequate cell capacity, electrode mismatch or other more fundamental faults which occur less frequently than those detected by the present method, and which can be rectified by adequate production control.

Figure 2:
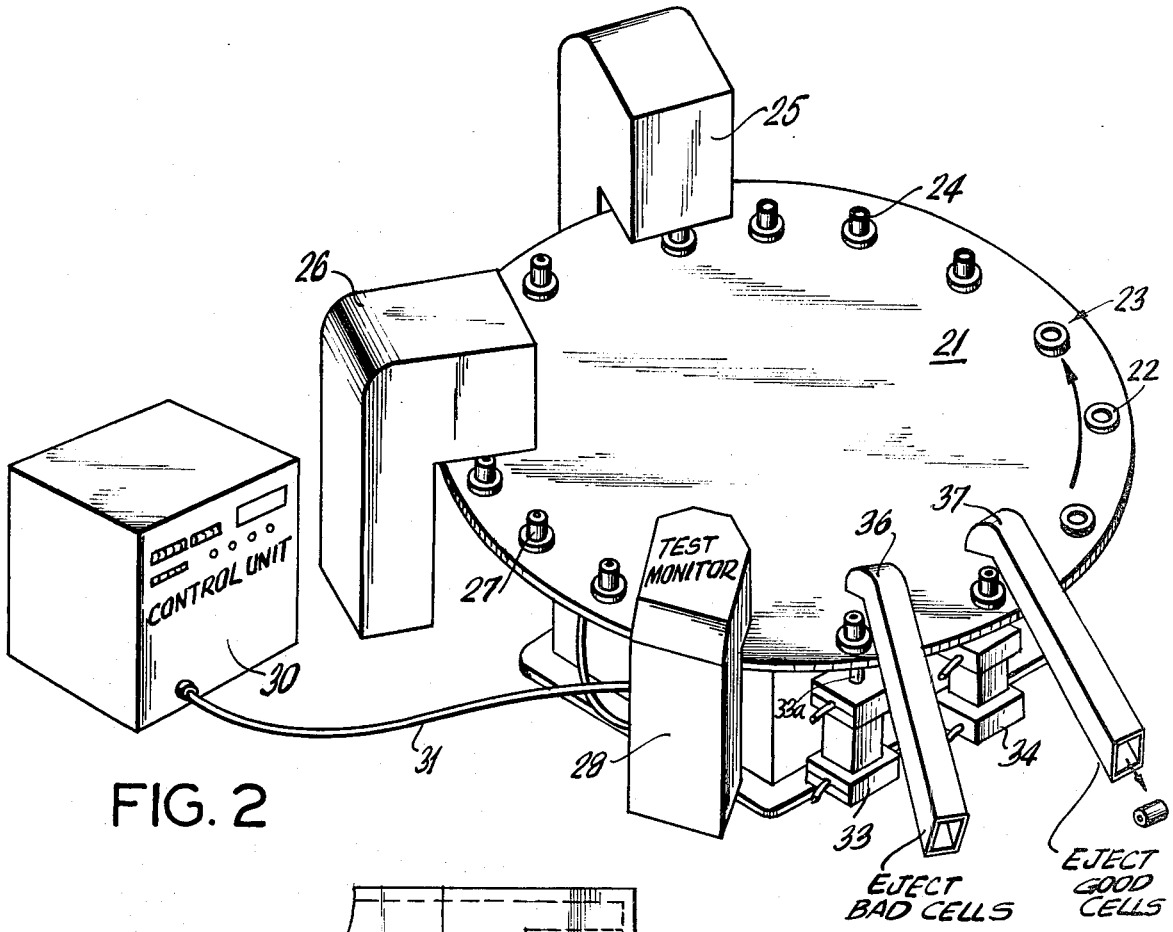
FIG. 2 is a perspective pictorial illustration of the final stages of a representative electrochemical cell assembly line incorporating on-line testing of the assembled cells.

FIG. 2 is an illustration of representative machinery used in the last stages of a cell assembly procedure. It is included here simply to aid in understanding how the present test method is fitted into the manufacturing sequence in actual practice.

Referring now to the drawing of FIG. 2, the final stages of a typical electrochemical cell assembly line are carried out by transporting the cells on a circular table 21, having a diameter of, but example, 3–4 feet. The table is provided with cell holders 22 evenly spaced about the perimeter of the table at angular intervals of about 20°. Thus, there are 18 cell holders 22 on the table 21. Partially completed cells consisting of the metallic cylindrical casing, open at the top, a coiled electrode assembly inside the casing, together with a liquid electrolyte-impregnated separator, are loaded by hand or by mechanical means into an empty cell holder at the position designated in the drawing by the numeral 23. The table 21 is of the indexing type and rotates, in discrete angular steps of 20°, by a suitable mechanical drive system (not shown). As the partially completed cells proceed in the circular path defined by the path of the cell holders as the table is indexed, various manufacturing operations are performed as, for example, welding the positive electrode closure member onto the positive electrode conductor tab, positioning the positive electrode closure assembly into the top of the cell casing, crimping the top edge of the battery casing over the outer edges of the closure, and vertically sizing the cell by compressing it in a sizing die. These operations are accomplished at various indexing positions about the perimeter of the table 21 by suitable apparatus, such as the crimping apparatus 25 and sizing apparatus 26.

Cells leaving the sizing apparatus, which is the last step in the manufacturing assembly, are complete and ready for testing. Testing is performed at the test monitor apparatus 28, which generates all testing functions under the control of a control unit 30, electrically connected to the monitor 28 via the electrical cable 31. In practice, the control unit 30 may also include other elements, such as air or hydraulic valves to control mechanical elements, such as the cell ejection cylinders 33, 34, associated with the testing function.

From the above, it will be understood that indexing the table transports the cells in discrete steps, each 20°, and that in between transport motions, there is a dwell period during which the various manufacturing operations are carried out. This dwell time is on the order of a few seconds. It is during this dwell time that each cell reaching the position of the test monitor 28 is tested. The test procedure detects cells which have met all of the performance tests, previously discussed, and those cells which do not. If a cell fails any test, an electrical signal is developed which causes the ejection air cylinder 33 to push the rejected cell upward into an ejection chute 36. To this end, a hole is located immediately below each cell holder 22 through which the plunger **33*a* of the ejection cylinder passes to push the cell upward into the ejection chute 36. Cells which have not been rejected, are indexed to the next succeeding position on the table and are there ejected by actuation of the ejection cylinder 34. The plunger of this cylinder pushes the separate cells into the ejection chute 37**.

Figure 3:
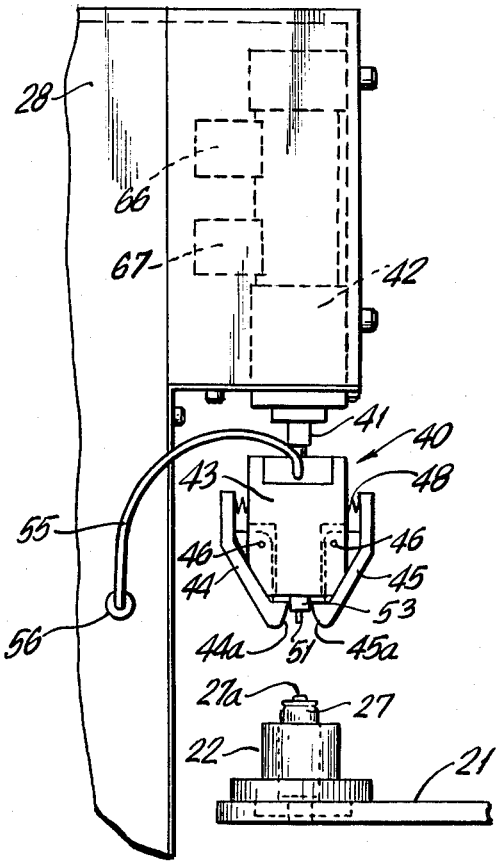
FIG. 3 is a side elevation view of a portion of an apparatus suitable for use in testing electrochemical cells according to the invention.

Reference should now be made to FIG. 3. This drawing illustrates a portion of the test monitor 28 used in subjecting the completed cells to testing. The function of the test monitor is to make contact with the cell electrodes in order to measure the cell's terminal voltage and to apply the current pulse. Shown in the lower portion of the drawing is a segment of the peripheral edge of the table 21 where it passes the test monitor. When the table is stationary, the cell holder 22 and cell 27 are positioned directly under the axis of an axially movable probe 40. This probe can be moved downwardly into contact with the cell and again retracted by actuation of an air-powered cylinder 42 located in the upper part of the monitor 28.

The probe 40 is mounted onto the plunger 41 of the air cylinder and includes a head portion 43 which is generally of rectangular cross-section and has tapered sides 43*a* at its lowermost portion. The head 43 carries a pair of movable contact arms 44, 45. These arms are mounted for limited pivotal movement about the pivots 46 and are resiliently biased into the position shown by a spring or plunger element 48 acting between the upper extremity of the arm and the body of the head portion 43. It will be understood that when the probe 40 is lowered into position by actuation of the air-powered cylinder 42, the arms 44, 45 will contact opposite sides of the upper periphery of the cell casing. Each of these arms terminates near the axis of the head in a rounded edge 44*a*, 45*a*, which is effective to urge the lower extremities of the arms to yield outwardly as the probe head is lowered into contact with the cell.

Extending from the lower edge of the probe is a pair of concentric electrical contacts adapted to make physical and electrical contact with the positive terminal at the center of the cell 27 under test. This pair of electrical contacts includes a resiliently biased retractable pin 51. Surrounding the pin 51 is a second contact 53 which is stationary and cylindrical in form, containing a bore for receiving the movable pin 51. The pin contact 51, cylindrical contact 53 and each of the arms 44, 45 which contact the cell casing (the negative terminal of cell) are connected to separate electrical conductors. These conductors are brought out as a unitary cable 55 and enter the monitor cabinet through a plug connector 56. Electrical signals on the conductors of the cable 55 are communicated via the cable 31 to the controller 30 during testing.

In operation, the test monitor senses when the indexing table 21 has reached a dwell position (during which time the table is stationary). It also senses whether or not a cell is present in the cell holder 22 by a suitable sensing arm (not shown) which is moved at any time a cell 27 projecting above the holder 22 moves into position beneath the probe 40. Upon the occurrence of these two events, the air cylinder 42 is actuated to extend the probe 40 until such time as the positive probe contacts 51, 53 have made physical contact with the positive terminal 27*a* of the battery. Once the probe 40 is fully extended, the test sequence may begin. The schematic illustration of FIG. 4, taken together with the functional wave form diagrams of FIG. 5, explain the test sequence.

Figure 4:
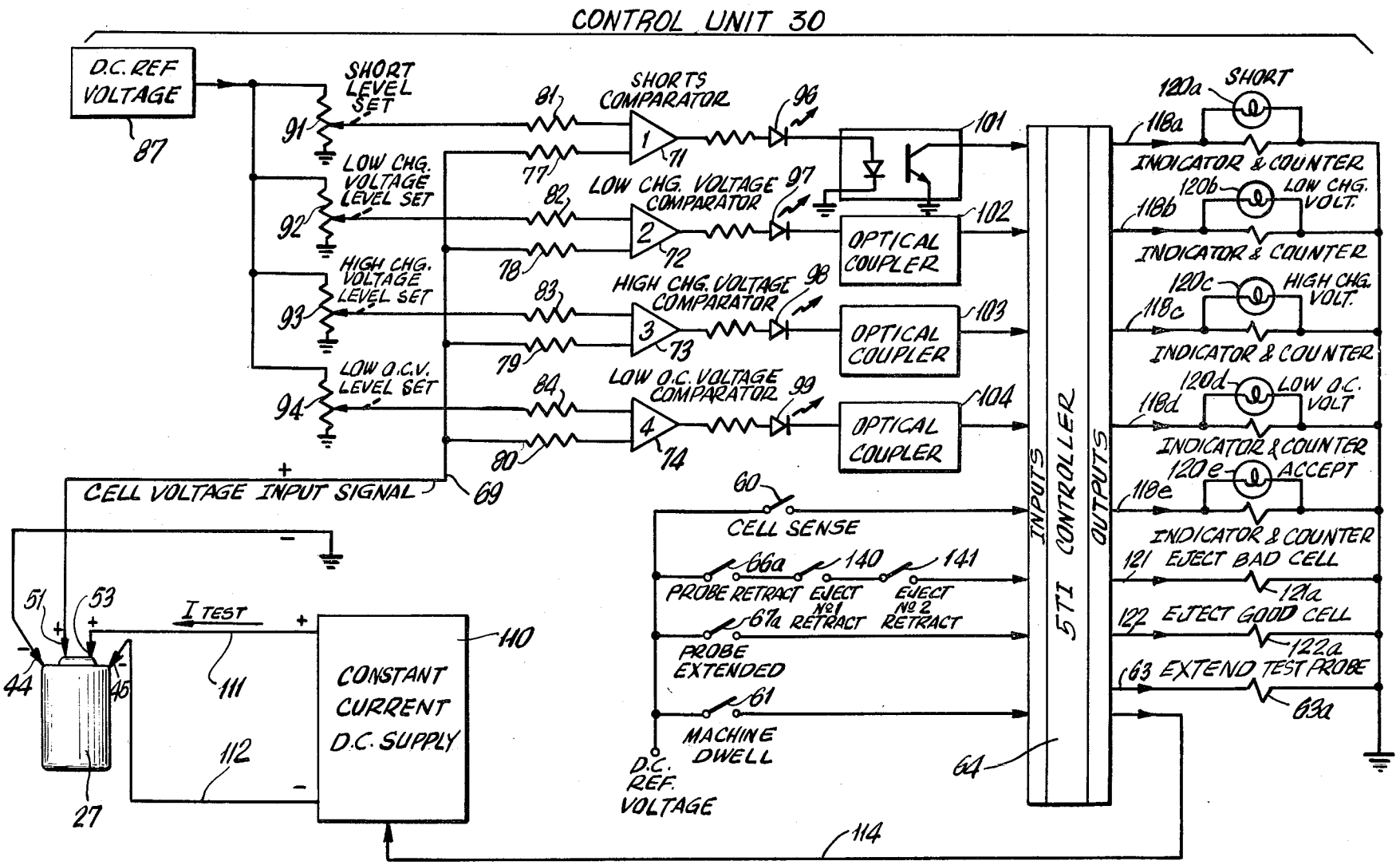
FIG. 4 is an electrical schematic diagram of an electrical system suitable for use in testing electrochemical cells in accordance with the invention.

Referring to FIG. 4, mechanically activated switches 60, 61, provide input signals to a programmable electronic controller 64. Controller 64 constitutes an element of the control unit 30. The occurrence of these two signals provides a signal on the output line 63 of the controller so as to energize the air valve which controls the air activated cylinder 42 for the test probe. The programmable controller is a solid state logic control system which can be programmed by the user. Basically, it accepts signal inputs and processes them in order to generate desired output signals capable of driving loads such as contractors, solenoids, power supply controls, and other functional elements. Systems of this type are available from commercial sources, such as from Texas Instruments under the designation "5TI Programmable Control System".

The air actuated probe cylinder 42 is equipped with a pair of switches 66,67 (see FIGS. 3 and 4) which detect full retraction and extension of the probe 40. The contact 67*a* of the switch 67 provides an input signal to the programmable controller 64 when the probe is extended and ready to apply and receive signals to and from the cell under test.

In FIG. 4, the cell under test 27 is shown pictorially. The probe contact 51 is connected by a lead 69 to the inputs of four separate voltage comparators 71, 72, 73 and 74. These comparators include operational amplifiers having inverting (−) and non-inverting (+) input connections. The cell voltage which is sensed on the input lead 69 is connected to the non-inverting input of each of the comparators through input resistors 77, 78, 79 and 80, respectively. This voltage signal is compared in each case against a unique reference voltage supplied to the inverting inputs to the comparators via the input resistors 81, 82, 83 and 84, respectively. The reference voltage originates from a direct current reference voltage power supply 87 which feeds four separate potentiometers 91–94 whose outputs are adjustable in accordance with the desired voltage level to be detected in the associated comparator. It will thus be understood that whenever the sensed cell voltage on the lead 69 exceeds the effective reference voltage fed to each comparator, the comparator output will switch from a negative state to a positive state. The occurrence of this event enables any of the light-emitting diodes 96–99 receiving a positive comparator output signal to conduct, thus providing not only a visible indication of the state of the comparator, but also energizing a light-emitting diode element within a respective optical coupler 101–104 that translates the comparator output signal into a suitable controller input.

In addition to the foregoing, the electrical system includes a constant direct current power supply 110 whose output is connected via the conductors 111, 112 to the probe contact 53 and contact arm 45. This power supply provides a predetermined constant current to the cell under test whenever its output is switched on. To that end, an output signal from the controller 64 is generated on the conductor 114 at the appropriate time in order to turn on current supplied to the cell. In practice, this may be accomplished by using the output signal on the lead 114 to control the pass transistor (in series with the output current) of the power supply output stage.

The controller 64 provides a number of output signals 118*a–e* which are used to control the testing procedure and to provide visual and electrical indications of test results. For example, these outputs are connected to a number of indicators, counters 120*a–e* to provide visual indications of faulty cell conditions, as well as acceptable cell conditions, and to drive electromagnetic (or electronic) numerical counters which indicate the number of cells found to have a particular type of fault. These output indications need not be displayed, but may be used solely to control the test procedure, or the manufacturing process. Thus, the controller 64 provides output signals for energizing the ejection cylinders 33, 34 at the appropriate time. Output 121 drives the air valve solenoid 121*a* to energize the bad cell ejector 33, while the controller output 122 is used to energize the air valve solenoid 122a for the good cell ejector 34. Of course, the relative positions of good and bad cell ejections could be reversed.

In operation, it will be understood that at appropriate times during the test procedure, the controller 64 causes the outputs of the comparators 71–74, coupled to the controller via the optical couplers 101–104, to be sampled. It will further be understood that the outputs of the comparators are logic signals, (i.e., either 1 or 0) and indicate simply whether the sampled cell voltage (whether it be the charge voltage or the open circuit voltage) has crossed a preset threshold level established by the potentiometers 91–94. As earlier noted, the sequence is initiated by the concurrent closing of the switches 60 and 61, signifying that a cell is present and that the machine table 21 has come to a rest.

Figure 5:
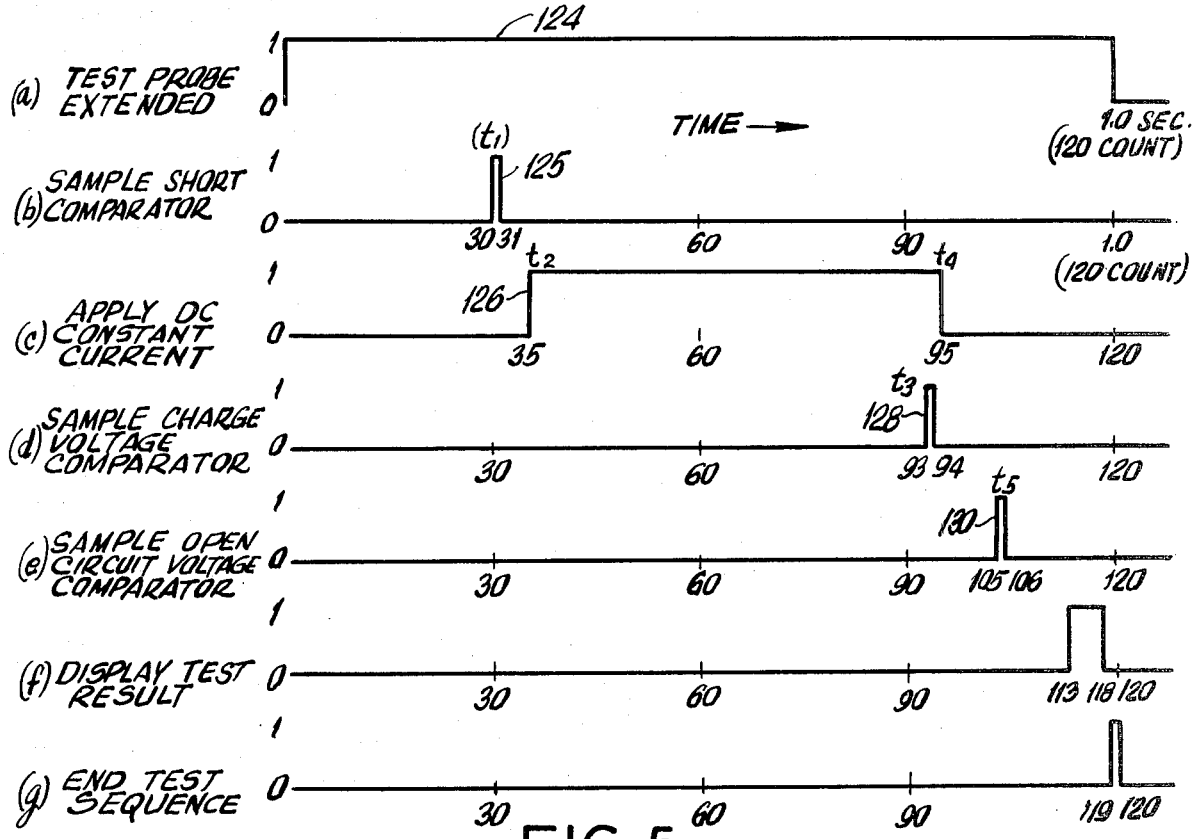
FIG. 5 is a graph depicting a number of pulse waveforms generated in the controller element of the electrical system of FIG. 4 and helpful in understanding the sequence of events occurring in the testing method to be described.

Full extension of the probe 40 into contact with the cell under test 27 initiates the logic signal of FIG. 5(a) and, in addition, starts a counter internal to the controller 64. It may be remarked at this time that the controller operates on a 120 Hz pulse frequency and, accordingly, its internal clocks operate at the rate of 120 pps. The numbers along the axes of the graphs FIG. 5 represent the number of pulses from the reference time t-0, 120 pulses being equal to 1.0 second. When the aforementioned counter attains a count of 30, the sample pulse 125 of FIG. 5(b) is generated. Internally of the controller 64, this pulse 125 causes the logic output of the shorts comparator 71 to be sampled and stored for subsequent readout. The pulse 125 occurs at a time $t_1$. The next event occurs at time $t_2$ (count 35) when the constant current dc supply 110 is turned on. Here again, an internal counter within the controller 64 energized at t-0 causes the logic 1 waveform 126 to occur at the count of 35. At this point in time, of course, the cell under test begins to develop a charge voltage across its terminals.

Upon turn-on of the dc test current, third and fourth internal counters are turned on simultaneously. The third counter generates an output pulse at 58 counts after turn-on of the dc test current. Thus, it causes an output pulse to be generated at time $t_3$, at the absolute count of 93 from the start of test. This pulse 128 is used to sample the outputs of the charge voltage comparators 72 and 73, coupled to the controller via the optical couplers 102, 103. The logical output signals from these comparators is stored for later readout. Two counts later, the fourth counter is activated (at time $t_4$) to turn off the test current. When this happens, a fifth internal counter is energized until it reaches a count of 10. This count is attained at time $t_5$, at a total count of 105, whereupon a third sample pulse 130 is generated in order to read out the logic output signal from the comparator 74. This time is also shown in FIG. 1 and is located so as to obtain a reading of the open-circuit voltage after removal of the current pulse.

At a time following the last voltage sampling ($t_5$), the tests results can be displayed, stored, or otherwise processed. This might occur, for example, between the counts of 113 and 118 or, if desired, the results can be displayed when obtained. At a count of 119, a pulse is generated to end the electrical testing sequence, thus completing all measurements. Of course, the controller may continue to exercise other test functions as, for example, operating the ejection cylinders 33, 34 stopping further advancement of the indexing table 21 should the rate of rejection exceed a predetermined limit, and initiating indexing of the table to the next position. This latter function is carried out when switches 66a, 140 and 141 (FIG. 4) sense that the probe and the ejection plungers the ejection plungers of the cylinders 33, 34 have been retracted.

It will be noted that unacceptable cells are not ejected at the test station, but rather of the following index position. To that end, indications of a cell whose performance is below par are stored for a period of time corresponding to one entire index cycle. This permits the ejection cylinder 33 to be energized in accordance with a cell performance signal from the previous test corresponding to the cell which has by that time moved into position over the cylinder 33.

Though the invention has been described with reference to both the preferred test procedure and preferred apparatus for conducting this procedure, numerous variations can be effected without departing from the spirit and scope of the invention. Thus, changes might be effected in the particular sampling times, the method of sampling, the apparatus for sensing over-and-under voltages, and for coupling such voltages to the controller, and numerous like changes. Additionally, changes can be made in the logical functions and in the manner in which faulty cell conditions are "indicated," this term embracing both electrical indications, visual indications or any other suitable indications which may be acted upon or which may cause or be used to effect automatic operations to occur, such as cell ejection and the like.

What is claimed is:

1. A method for rapidly testing rechargeable electrochemical cells for defects following assembly while the cells are in a substantially uncharged condition, comprising:

applying a current to the uncharged electrodes via the positive and negative terminals of the assembled cell under test, said current substantially having a magnitude greater than the one-hour current capacity of the cell and applied for a duration sufficient to develop an increased voltage between the cell terminals but insufficient to sustain the attained voltage upon removal of such current;

measuring the charge voltage so developed during application of said current at said magnitude and while the electrodes of the cell are incompletely charged; and thereafter terminating said current so that the total charge applied to the cell does not exceed about one percent (1%) of the cell's fully charged capacity.

2. The method of claim 1, wherein:

said applied current is substantially constant during the period of current application.

3. The method of claim 1 wherein:

said current is applied for a time sufficient to cause the charge voltage developed between electrodes of a normal cell to attain a substantially constant value.

4. The method of claim 3, wherein:

the current is applied in sufficient magnitude and for sufficient duration so as to cause the magnitude of the voltage developed between the cell terminals to exceed the open circuit voltage for the cell.

5. The method of claim 1 wherein:

the current is applied at a magnitude and for a time such that the total current charge accumulated by the cell is less than about one percent (1%) of the total charge capacity of the cell when fully charged.

6. The method of claim 5, wherein:

the charge voltage of the cell is measured after said current has been applied for a predetermined period of time, the method further comprising:

comparing, at said predetermined time, the measured charge voltage with at least one predetermined zone of values representing a minimum acceptable performance level for the cell, and providing an indication when said measured charge voltage is outside the predetermined zone.

7. The method of claim 1, further comprising:

comparing the measured charge voltage with a predetermined maximum value representing a condition of insufficient electrolyte within the cell; and providing an indication when the measured charge voltage exceeds the predetermined maximum value.

8. The method of claim 1, further comprising:

comparing the measured voltage with a predetermined minimum charge voltage value representing a condition of partial interelectrode shorting of the cell; and providing an indication when the measured cell voltage is less than the predetermined minimum charge voltage value.

9. The method of claim 1, further comprising:

measuring the open circuit voltage between the cell terminals upon removal of said current.

10. The method of claim 9, further comprising:

comparing the measured open circuit voltage with a predetermined minimum open circuit voltage representing a condition of partial interelectrode shorting of the cell; and providing an indication when the measured open circuit cell voltage is less than the predetermined minimum value for the open circuit voltage.

11. The method of claim 1, further comprising:

measuring the open circuit voltage of the substantially uncharged cell at the terminals prior to application of said current, comparing the measured open circuit cell voltage with a predetermined minimum value representing a low resistance interelectrode shorting of the cell, and providing an indication in the event the measured open circuit cell voltage is less than the predetermined minimum value.

12. The method of claim 11, wherein:

the predetermined minimum value for the open circuit cell voltage is less than about five percent (5%) of the value of the open circuit voltage when the cell is fully charged.

13. The method of claim 1, wherein:

the charge voltage is measured so as to provide an indication of the rate of change of voltage upon application of the constant current.

14. The method of claim 1, wherein at least one electrode of the cell at the time of measurement is in an unformed state.

15. A method for rapidly testing rechargeable electrochemical cells for manufacturing defects immediately following assembly while the cells are in a substantially uncharged condition, comprising:

applying a current pulse to the uncharged electrodes via the terminals of the assembled cell under test, said current pulse having a magnitude greater than the one-hour current capacity of the cell and being applied for a time insufficient to impose a substantial charge on the cell electrodes and insufficient to sustain the cell voltage attained during application of said current pulse, and measuring the open circuit voltage of the cell after termination of the current pulse.

16. The method of claim 15, wherein:

the total charge applied to the cell terminals by the current pulse is less than about 1% of the total charge capacity of the cell when fully charged.

17. The method of claim 16, wherein:

at least one of the cell electrodes is unformed upon application of the current pulse.

18. A method for rapidly testing rechargeable electrochemical cells on an assembly line basis upon completion of cell assembly and prior to formation of the cell electrodes, comprising:

contacting cells on the assembly line seriatim with electrical supply means adapted to apply a current to the terminals of the completed cell to be tested, energizing said electrical supply means contacting such cell so as to apply a current to the unformed electrodes of the cell via the cell terminals, said current being greater than the one-hour current rating of said cell and for such time period as to develop a charge voltage between the cell terminals, and measuring the charge voltage developed during application of said current and while the electrodes of the cell are incompletely charged.

19. The method of claim 18, further comprising:

comparing the measured charge voltage with a predetermined zone of values representing satisfactory cell performance and separating from said assembly line those cells whose measured charge voltage values are outside the predetermined zone.

20. The method of claim 19, wherein:

the total current charge applied to said cell prior to measurement is significantly less than the total charge capacity of the cell when the formed electrodes thereof are completely charged.

21. The method of claim 20, wherein:

the current is applied to the cell under test in such magnitude and for such time as to produce a charge voltage which is substantially constant for a normal cell, and the measurement of the cell voltage is made after such time.

22. The method of claim 18, further comprising:

providing a first indication of the number of cells tested wherein the value of the measured charge voltage was outside the predetermined zone of values.

providing a second indication of the total number of cells tested, and comparing said first and second indications to detect a predetermined ratio between the numbers represented thereby, and stopping the cell assembly line upon detection of such ratio.

23. The method of claim 18, further comprising:

terminating the applied current prior to cell's attainment of a substantial charge, measuring the open circuit voltage at the cell terminals upon termination of the applied current, comparing the measured open circuit voltage with a predetermined minimum value representing satisfactory cell performance, and separating from the assembly line those cells whose measured open circuit voltage value is less than said predetermined minimum value.

24. The method of claim 18, wherein the step of contacting the cell with electrical supply means includes:

supplying current to an actuatable probe, moving said probe in the direction of the axis of the cell to be tested upon actuation so as to contact the terminals of the cell with said probe.

25. A method for rapidly testing rechargeable electrochemical cells for defects following assembly while the cells are in a substantially uncharged condition, comprising:

applying a current to the uncharged electrodes via the positive and negative terminals of the assembled cell under test, such current having a magnitude at least twice the one hour current capacity of the cell and applied for a duration sufficient to develop an increased voltage between the cell terminals but insufficient to sustain the attained voltage upon removal of such current;

electrically sampling the charge voltage so developed during application of said current at said magnitude and while the electrodes of the cell are substantially uncharged;

comparing said sampled charge voltage with a reference voltage representing a desired minimum level of acceptable performance;

thereafter terminating said applied current; and providing an indication when the sampled charge voltage departs from said reference voltage by a predetermined amount.

26. The method of claim 25, wherein:

the total charge applied to the cell by said current does not exceed about one percent (1%) of the cell's fully charged capacity.

27. A method for rapidly testing rechargeable electrochemical cells for defects following assembly while the cells are in a substantially uncharged condition, comprising;

applying a current pulse to the uncharged electrodes via the positive and negative terminals of the assembled cell under test, said current having a magnitude substantially greater than the one-hour current capacity of the cell and applied for a duration sufficient to develop an increased voltage between the cell terminals but insufficient to sustain the attained voltage upon removal of such current, the total charge applied to said cell by said current pulse not exceeding about one percent (1%) of the total charge capacity of said cell;

electrically measuring the current voltage developed during application of said current pulse and while the electrodes of the cell remain substantially uncharged;

storing an indication of said charge voltage measurement; and thereafter terminating said current pulse.

28. The method of claim 27, wherein said charge voltage is measured at a time during which the developed charge voltage is increasing as a function of time, and said stored indication represents a function of the rate of change of said voltage.

* * * * *